US005928025A

United States Patent [19]

Abe

[11] Patent Number: 5,928,025

[45] Date of Patent: Jul. 27, 1999

[54] INSULATION DISPLACEMENT TERMINAL

[75] Inventor: Kimihiro Abe, Shizuoka, Japan

[73] Assignee: Yazaki Corporation, Tokyo, Japan

[21] Appl. No.: 08/902,953

[22] Filed: Jul. 30, 1997

[30] Foreign Application Priority Data

Aug. 8, 1996 [JP] Japan ..... 8-210126

[51] Int. Cl.[6] ..... H01R 4/24

[52] U.S. Cl. ..... 439/397

[58] Field of Search ..... 439/397, 398, 439/400, 401, 406, 407

[56] References Cited

U.S. PATENT DOCUMENTS

| | | | |
|---|---|---|---|
| 4,385,794 | 5/1983 | Lucius | 439/401 |
| 4,948,382 | 8/1990 | Marpoe et al. | 439/401 |
| 5,133,672 | 7/1992 | Nelligan | 439/397 |
| 5,380,218 | 1/1995 | Yamamoto et al. | 439/397 |

*Primary Examiner*—Neil Abrams
*Assistant Examiner*—J. F. Duverne
*Attorney, Agent, or Firm*—Sughrue, Mion, Zinn, Macpeak & Seas, PLLC

[57] ABSTRACT

A crimping terminal includes an electrically conductive plate including: an electrical contact section engageable with another terminal; a wire clamping section for clamping a wire thereto; an insulation displacement conductive section formed to locate between the electrical contact section and the wire clamping section, the insulation displacement conductive section having a bottom wall, a first side wall and a second side wall, the first and second side walls which have first and second insulation displacement blades extending inwardly to confront each other so as to define a insulation displacement slot therebetween; and a coupling section, which is substantially U-shaped in cross-section, having a bottom wall, a first side wall and a second side wall, the coupling section being formed in at least one of the portions between the insulation displacement conductive section and the wire clamping section and between the insulation displacement conductive section and the electrical contact section, the coupling section having a squeezed portion formed to gradually reduce a size of a part of the U-shaped cross-section of the coupling section.

7 Claims, 4 Drawing Sheets

INSULATION DISPLACEMENT TERMINAL

BACKGROUND OF THE INVENTION

1. Field of the Invention

This invention relates to an insulation displacement terminal which is so designed that, when a covered conductor (or electrical wire) is press-fitted into an insulation displacement slot, the internal conductor is brought into contact with the terminal without removal of the insulating cover of the covered conductor.

2. Background

FIGS. 4*a* to 4*c* show a conventional insulation displacement terminal disclosed by U.S. Pat. No. 4,385,794. More specifically, FIG. 4*a* is a perspective view of the insulation displacement terminal, FIG. 4*b* is a sectional view taken along line IVb—IVb, and FIG. 4*c* is a perspective view showing part of a covered wire connected to the insulation displacement terminal.

In FIG. 4, reference numeral 1' designates the aforementioned conventional insulation displacement terminal. The insulation displacement terminal 1' is formed integrally by pressing a piece of thin metal sheet which is punched. The insulation displacement terminal 1' includes an electrical contact section 2', engageable with a mating terminal, is formed at a front end portion thereof, a wire clamping section 3' formed at a rear end portion thereof, and an insulation displacement conductive portion 4' is formed at the middle portion between the front and rear end portions. More specifically, the electrical contact portion 2' is engageable with the mating terminal so as to be electrically connected to each other, the wire clamping section 3' has right and left retaining pieces (parts of the walls) 3*a*', which are bent inwardly to fixedly hold an insulating cover Wb of a wire W from the above, and the insulation displacement conductive section 4' is electrically connected to the conductor Wa of the wire W. The wire clamping section 3' is coupled through a first neck 6' to the insulation displacement conductive section 4', and the insulation displacement conductive section 4' is coupled through a second neck 7' to the electrical contact section 2'.

The insulation displacement conductive section 4' has a front insulation displacement portion 10A' and a rear insulation displacement portion 10B' which are arranged at the front and rear ends thereof. The front insulation displacement portion 10A' has a pair of right and left insulation displacement blades 11' and 11' which are confronted with each other in such a manner as to form an insulation displacement slot 12' between them into which the conductor Wb of the wire W is inserted. Similarly, the rear insulation displacement portion 10B' also has right and left insulation displacement blades 11' and 11' which are confronted with each other in such a manner as to form an insulation displacement slot 12' between them into which the conductor Wb of the wire W is inserted.

The wire clamping section 3', and the insulation displacement conductive section 4', and the electrical contact section 2' have a common bottom wall having the first neck 6' and the second neck 7'. The insulation displacement conductive section 4' is substantially U-shaped in section. More specifically, the insulation displacement conductive section 4' has a part of the bottom wall between the first neck 6' and the second neck 7', and right and left side walls 9' and 9' which extend upwardly from the right and left edge portions of the bottom wall, respectively. The insulation displacement blades 11' of the insulation displacement portions 10A' and 10B' are respectively formed by inwardly bending the front and rear end portions of the side walls 9'. The insulation displacement conductive section 4 has recesses 18 which are formed by pressing on the lines along which the side walls 9' are bent with respect to the bottom wall, so that the insulation displacement conductive section 4' is increased in bending rigidity.

The wire W is connected to the insulation displacement terminal 1' as follows. First, one end portion of the wire W is laid on the rear end portion of the insulation displacement terminal 1' in such a manner that the one end portion of the wire W is in parallel with the rear end portion of the insulation displacement terminal 1'. Under this condition, the one end portion of the wire W is pushed in the insulation displacement slots 12' of the insulation displacement conductive section 4 from the above. Accordingly, the right and left insulation displacement blades 11' cut the insulating cover Wb of the wire W, and contact the conductor Wa of the wire W. When the one end portion of the wire W is further pushed in, the conductor Wa is moved to be between the right and left insulation displacement blades 11', so that the conductor Wa is more positively held by the right and left insulation displacement blades 11'. In this operation, a force is applied to the right and left insulation displacement blades 11' so that the insulation displacement blades 11' are moved away from each other.

In general, an insulation displacement terminal is mass-produced, and a number of insulation displacement terminals are built in a connector housing in such a manner that they are adjacent to one another. Hence, there has been a strong demand for the provision of an insulation displacement terminal which is small in size, and light in weight. In order to decrease the weight of the insulation displacement terminal, it is essential to reduce the thickness of a metal plate which is formed into the insulation displacement terminal. And in order to miniaturize the insulation displacement terminal, it is necessary to decrease the width and the length of the insulation displacement terminal. For instance, in order to decrease the width of the insulation displacement terminal, it is essential to decrease the width of the insulating displacement blades forming the insulation displacement slot.

However, if the thickness of the metal plate, which is used to form the insulation displacement terminal, is decreased, or if the width of the insulation displacement blades is decreased, then the mechanical strength of the insulation displacement blades is also decreased, as a result of which, when the wire is pushed in the insulation displacement slot, the right and left insulation displacement blades are opened outwardly.

In view of the foregoing, in the conventional insulation displacement terminal 1' shown in FIGS. 4*a* to 4*c,* the insulation displacement blades 11' are respectively formed by bending inwardly the front and rear end portions of the side walls 9' of the insulation displacement conductive section 4'. However, the force, acting on the insulation displacement blades 11' when the wire W is press-fitted into the insulation displacement slots 12', acts collectively on the junctions (the bent portions) of the side walls 9' and the bottom wall. Therefore, there is a possibility that the side walls 9' are bent outwardly, and accordingly, the insulation displacement blades 11' are bent outwardly. In order to overcome this difficulty, the recesses 18' are formed on the junctions of the side walls 9' and the bottom wall. However, the recesses 18' are not so effective in preventing the falling of the upper end portions of the side walls 9'; that is, they are not so effective in preventing the insulation displacement blades 11' from being opened.

Furthermore, as shown in FIG. 4*a,* since an area in which the recesses 18' for reinforcing the side walls 9' is formed is restricted to the length of the insulation displacement conductive section 4' shown by an arrow A, there is a possibility that reinforcement for the side walls 9' can not be provided if it is difficult to form the recesses 18' in the area.

SUMMARY OF THE INVENTION

Accordingly, an object of the invention is to eliminate the above-described difficulties accompanying a conventional insulation displacement terminal.

More specifically, an object of the invention is to provide an insulation displacement terminal which is miniaturized, and in which, when the wire is pushed in between the insulation displacement blades, the latter are prevented from being opened outwardly; that is, to improve the reliability in electrical connection of the insulation displacement terminal.

The foregoing object and other objects of the invention have been achieved by an insulation displacement terminal which includes an electrically conductive plate including: an electrical contact section engageable with another terminal; a wire clamping section for clamping a wire thereto; an insulation displacement conductive section formed to locate between the electrical contact section and the wire clamping section, the insulation displacement conductive section having a bottom wall, a first side wall and a second side wall, the first and second side walls which have first and second insulation displacement blades extending inwardly to confront each other so as to define an insulation displacement slot therebetween; and a coupling section, which is substantially U-shaped in section, having a bottom wall, a first side wall and a second side wall, the coupling section being formed in one of portions between the insulation displacement conductive section and the wire clamping section and between the insulation displacement conductive section and the electrical contact section, the coupling section having a squeezed portion formed to gradually reduce a size of a part of the U-shaped section of the coupling section.

In the insulation displacement terminal as was described above, the coupling section coupled to the insulation displacement conductive section has the squeezed portion. Therefore, the step which attributes to the change in sectional configuration of the squeezed portion, the coupling section is increased in mechanical strength, and accordingly especially the side walls of the insulation displacement conductive section are reinforced. Hence, the first and second side walls of the insulation displacement conductive section are substantially prevented from falling aside; that is, when the wire is pushed in the insulation displacement slots of the insulation displacement conductive section, the first and second insulation displacement blades are prevented from being opened outwardly.

Further, in the insulation displacement terminal, the wire clamping section has a bottom wall, a first side wall and a second side wall, the first side wall and the second side wall are respectively bent inwardly to clamp the wire through an insulating cover thereof.

Further, in the insulation displacement terminal, the coupling section is provided between the insulation displacement conductive section and the wire clamping section so that the side walls of the insulation displacement conductive section are coupled to the side walls of the wire clamping section through the side walls of the coupling section, respectively, and the bottom wall of the insulation displacement conductive section is coupled to the bottom wall of the wire clamping section through the bottom wall of the coupling section.

In the insulation displacement terminal as was described above, the insulation displacement conductive section is continuously coupled to the wire clamping section through the coupling section, and therefore the side walls of the insulation displacement conductive section are restricted by the wire clamping section. Accordingly, when the wire is pushed in the insulation displacement slots of the crimping conductive section, the first and second insulation displacement blades are scarcely opened outwardly because the side walls having the insulation displacement blades are restricted in movement. The clamping of the wire and the pushing of the wire in the insulation displacement slots may be carried out at the same time; in this case, the side walls of the wire clamping section are bent inwardly when the wire is clamped. Therefore, even if the insulation displacement blades of the insulation displacement conductive section tend to open outwardly as the wire is pushed in the insulation displacement slots, the opening of the insulation displacement blade is prevented because an inward force acting on the side walls of the wire clamping section, and the outward force acting on the side walls of the insulation displacement conductive section through the insulation displacement blades are canceled out by each other.

Further, in the insulation displacement terminal, the squeezed portion is formed so as to gradually change a sectional configuration of the bottom wall of the coupling section from flat to arcuate in section along both sides toward the bottom center.

In the insulation displacement terminal as was described above, the sectional configuration of the bottom wall is changed gradually from flat to arcuate along both sides toward the bottom center thereof, which reinforces the coupling sections.

Further, in the insulation displacement terminal, the first and second side walls of the insulation displacement conductive section have first openings, respectively, and protrusions extended from the front and rear edges of each of the first openings are bent inwardly to form the insulation displacement blades.

In the insulation displacement terminal as was described above, the first openings are formed in the side walls of the insulation displacement conductive section, and the protrusion extended from the front and rear edges of each of the first openings are bent inwardly to form the insulation displacement blades. Therefore, the peripheral portion of each of the side walls remain in the form of a frame.

Further, in the insulation displacement terminal, the first and second side walls further have second openings in such a manner that the second openings are in alignment with the first openings, and protrusions extended from one of a front edge and a rear edge of the second openings are bent inwardly to form the insulation displacement blades.

In the insulation displacement terminal as was described above, because of the formation of the first and second openings in the side walls, at least three insulation displacement portions are arranged in the front-to-rear direction, and, in the side walls, those insulation displacement portions are all continuous to one another. This feature prevents the insulation displacement blades of the insulation displacement portions from being opened outwardly.

BRIEF DESCRIPTION OF THE DRAWINGS

FIG. 1*a* is a plan view of the insulation displacement terminal, FIG. 1*b* is a side view of the insulation displacement terminal, FIG. 1*c* is a sectional view taken along line Ic—Ic in FIG. 4*b, * and FIG. 1*d* is a sectional view taken along line Id—Id in FIG. 4*b;*

FIG. 4*a* is a perspective view showing the whole arrangement of the conventional insulation displacement terminal, FIG. 4*b* is a sectional view taken along line IVb—IVb in FIG. 4*a,* and FIG. 4*c* is a perspective view shown a part of the conventional insulation displacement terminal in which a wire is press-fitted.

DETAILED DESCRIPTION OF THE PREFERRED EMBODIMENTS

Preferred embodiments of the invention will be described with reference to the accompanying drawings.

First Embodiment

An example of an insulation displacement terminal of a first embodiment of the invention will be described with reference to FIGS. 1*a* through 2.

Figure 1A:
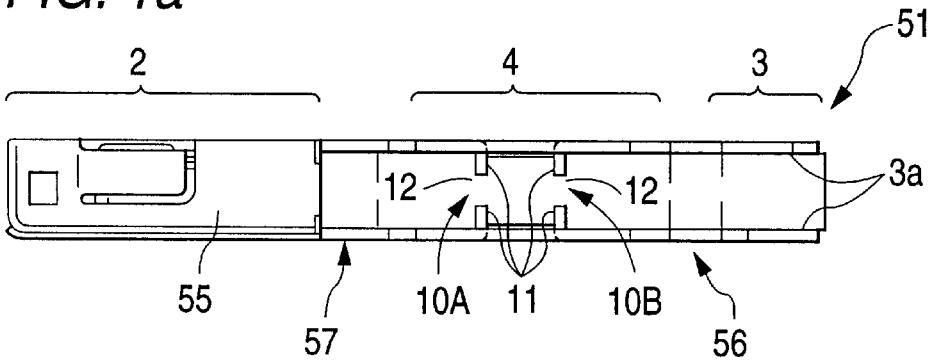
FIGS. 1*a* to 1*d* show an arrangement of an example of an insulation displacement terminal of a first embodiment of the invention.
Figure 1B:
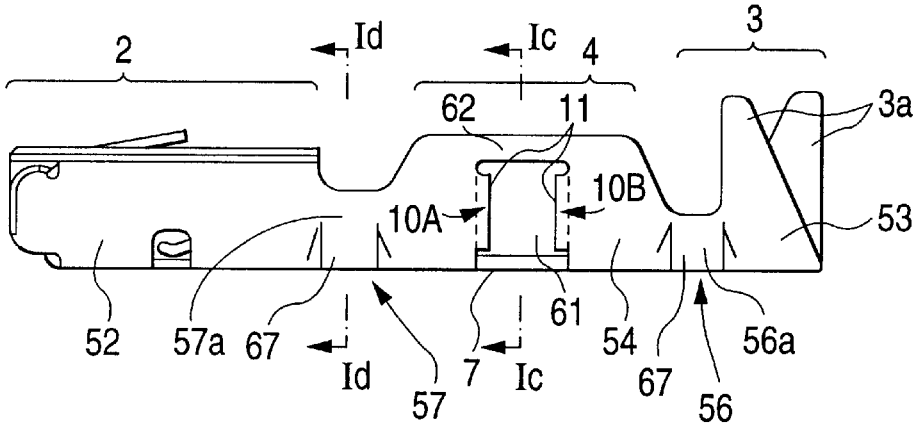
Figure 1C:
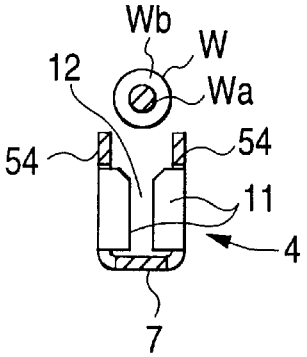
Figure 1D:
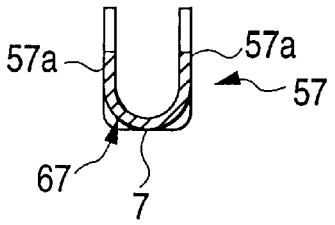
Figure 2:
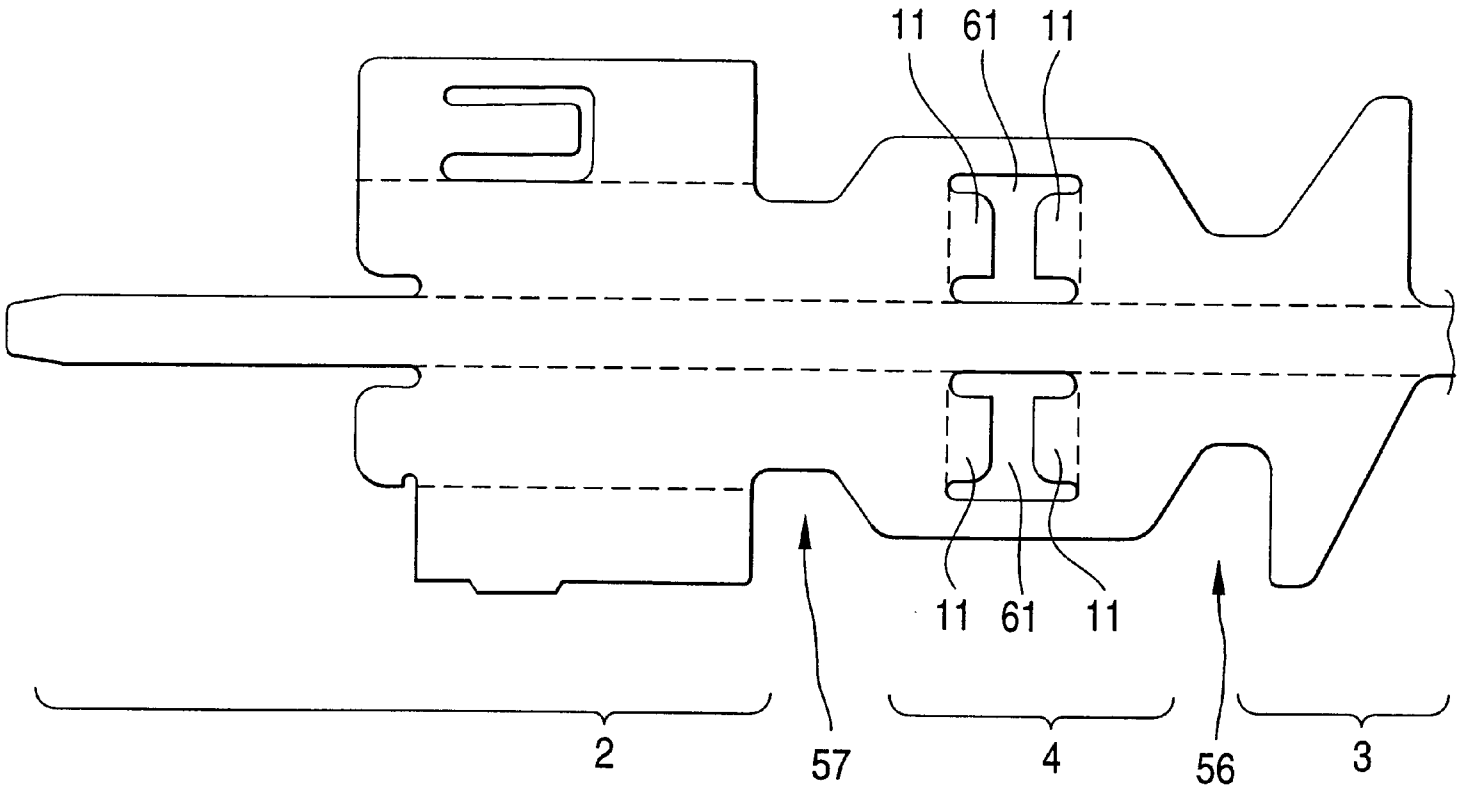
FIG. 2 is an unfolded diagram of the insulation displacement terminal of the first embodiment of the invention.

In FIGS. 1*a* to 2, reference numeral 51 designates the insulation displacement terminal, the first embodiment of the invention. The insulation displacement terminal 51 is formed integrally by pressing a piece of thin metal terminal which is punched as shown in FIG. 2. The insulation displacement terminal 51 has an electrical contact section 2, engageable with a mating terminal, formed at a front end portion thereof, a wire clamping section 3 formed at a rear end portion thereof, and an insulation displacement conductive section 4 formed at the middle portion between the front and rear end portions. In FIG. 2, each reference number indicates each part of the insulation displacement terminal 51.

The electrical contact section 2 is engaged with the mating terminal so that the electrical contact section 2 is electrically connected to the mating terminal. The electrical contact section 2 has right and left side walls 52, a top wall 55, and a part of a bottom wall, and is formed in a box-like shape. The wire clamping section 3 is to hold a wire W from the above of a insulating cover Wb of the wire W. The wire clamping section 3 is U-shaped in section, and has a part of the bottom wall 7, and right and left side walls 53. The right and left side walls 53 have retaining pieces 3*a* at upper end portions thereof, respectively. The wire W is held by bending the retaining pieces 3*a* inwardly. The insulation displacement conductive section 4 is arranged to electrically contact a conductor Wa of the wire W. The insulation displacement conductive section 4 is also U-shaped in section, and has a part of the bottom wall 7, and right and left side walls 54. The wire clamping section 3 is coupled to the insulation displacement conductive section 4 through a first coupling section 56 which is U-shaped in section and has a part of the bottom wall 7 and right and left side walls 56*a*. The insulation displacement conductive section 4 is coupled to the electrical contact section 2 through a second coupling section 57 which is also U-shaped in section, and has a part of the bottom wall 7, and right and left side walls 57*a*.

As was described above, the bottom wall 7 is extended from the wire clamping section 3 up to the electrical contact section 2 as a piece of common belt-shaped wall. The right side walls 53, 56*a,* 54, 57*a* and 52 are formed with a substantially continuous flat plate, and similarly the left side walls 53, 56*a,* 54, 57*a* and 52 are also formed with a substantially continuous flat plate. That is, those right and left side walls 53, 56, 54, 57*a* and 52 are extended upwardly from the right and left edges of the common bottom wall 7 by bending upwardly wall plates at right angles.

The first coupling section 56 has a squeezed portion 67 formed in such a manner that the U-shaped section formed by a part of the bottom wall 7, and the right and left side walls 56*a* is gradually changed. Similarly, the second coupling section 57 has a squeezed portion 67 formed in such a manner that the U-shaped section formed by a part of the bottom wall 7, and the right and left side walls 57*a* is gradually changed. Each of the squeezed portions 67 is shaped so as to change the bottom wall 7 from flat to arcuate in section along both sides toward the bottom center. The section of the squeezed portion 67 of the second coupling section 57 is as shown in FIG. 1*d.* The section of the squeezed portion 67 of the first coupling section 56 is similar to the section of the squeezed portion 67 of the second coupling section 57. Those squeezed portion 67 is formed when the pressing process is performed.

The insulation displacement conductive section 4 has a front insulation displacement portion 10A and a rear insulation displacement portion 10B respectively at the front and rear end portions thereof. Each of the insulation displacement portions 10A and 10B, as shown in FIG. 1*c,* has a pair of right and left insulation displacement blades 11 between which an insulation displacement slot 12 is formed. The conductor Wa of the wire W is press-fitted into the insulation displacement slot 12. The right and left walls 54 of the insulation displacement conductive section 4 have two rectangular openings 61 (hereinafter referred to as "first openings 61", when applicable), respectively. Protrusions extended from the front and rear edges of each of the first openings 61 are bent inwardly to form the aforementioned insulation displacement blades 11. The wall located above each of the first openings 61 (or a part of the side walls 54) remains as a coupling wall 62, so that the right insulation displacement blades of the front and rear insulation displacement portions 10A and 10B are coupled to each other, and similarly, the left insulation displacement blades of the front and rear insulation displacement portions 10A and 10B are coupled to each other.

In the insulation displacement terminal 51, the first openings 61 are formed in the side walls 54, respectively, and the protrusions extended from the front and rear edges of the openings 61 are formed into the insulation displacement blades 11. Hence, the peripheral portion of each of the side walls 54 remains like a frame, so that the side walls 53, 56*a,* 54, 57*a* and 52 are provided as one continuous unit on each of the right and left sides of the insulation displacement terminal.

Now, the operation of the insulation displacement terminal will be described.

The wire W is connected to the insulation displacement terminal as follows: One end portion of the wire W is laid on the rear end portion of the insulation displacement terminal 51 in such a manner that the one end portion of the wire W is in parallel with the rear end portion of the insulation displacement terminal 51. Under this condition, the one end portion of the wire W is pushed down into the insulation displacement slots 12 from the above. Accordingly, the right and left insulation displacement blades 11 cut the insulating cover Wb of the wire W, and are brought into contact with the conductor Wa of the wire W from both sides. When the one end portion of the wire W is further pushed down, the conductor Wa is caused to go in between the right and left insulation displacement blades 11 and is positively held by the right and left insulation displacement blades 11.

In this operation of the one end portion of the wire W being pushed down into the insulation displacement slots 12, a force is applied to move the right and left insulation displacement blades outwardly (away from each other); however, this movement is prevented for the following reason: In the insulation displacement terminal 51, the electric contact section 2, the insulation displacement conductive section 4 and the wire clamping section 3 have the right side walls 52, 54 and 53, respectively. The right side walls 52, 54 and 53 are provided as one continuous side wall, and similarly the left side walls 52, 54 and 53 are also provided as one continuous side wall. In addition, the first coupling section 56, through which the insulation displacement conductive section 4 is coupled to the wire clamping section 3, is U-shaped in section, having a part of the bottom wall 7, and the right and left side walls 56*a;* and similarly the second coupling section 57, through which the insulation displacement conducting section 4 is coupled to the electrical contact section 2, is also U-shaped in section, having the bottom wall 7, and the right and left side walls 57*a*. Hence, the insulation displacement terminal 51 is increased in rigidity as a whole, and the side walls 54 of the insulation displacement conductive section 4 are greatly restricted by the side walls 52 and 54 of the electrical contact section 2 and the wire clamping section 3. In addition, since the electrical contact section 2 is in the form of a box, the restricting force by the side walls 52 of the electrical contact section 2 is considerably great.

Furthermore, the first and second coupling sections 56 and 57 coupled to the insulation displacement conductive section 4 have the squeezed portions 67. Therefore, the step, which is due to the change in section of the squeezed portions 67, increases the mechanical strength of the coupling sections 56 and 57, and accordingly especially the side walls 54 of the insulation displacement conductive section 4 is further reinforced. Therefore, even when a force is applied to open the insulation displacement blades 11 of the insulation displacement conductive section 4 outwardly, the side walls 54 forming the insulation displacement blades 11 are restricted at the front and rear end; that is, the crimping blades 11 will never be opened outwardly.

In the case where the wire W is clamped with the wire clamping section 3 while the wire W is pushed in the insulation displacement conductive section 4, the retaining pieces 3*a* which are the upper end portions of the side walls 53 of the wire clamping section 3 are bent inwardly. Therefore, even if the insulation displacement blades 11 of the insulation displacement conductive section 4 are caused to open outwardly as the wire W is pushed in, the inward force acting on the side walls 53 of the wire clamping section 3, is canceled out by the outward force which the insulation displacement blades 11 of the insulation displacement conductive section 4 applies to the side walls 54, so that the insulation displacement blades 11 are more positively prevented from being opened outwardly.

Accordingly, the right and left side walls 54 of the insulation displacement conductive section 4 are scarcely caused to fall aside, and when the wire W is pushed in the insulation displacement slots 12 of the insulation displacement conductive section 4, the right and left insulation displacement blades are prevented from being opened out side. Therefore, when the width of the insulation displacement blades 11 is decreased to miniaturize the insulation displacement terminal, the insulation displacement terminal is free from the difficulty that, when the wire is pushed in the insulation displacement slots, the insulating cover Wb is insufficiently cut with the insulation displacement blades 11. Furthermore, the contact load (or holding load) on the conductor Wa of the wire W can be high enough; that is, the electrical connection is improved in reliability.

In this case, the insulation displacement conductive section 4 is not directly subjected to squeezing, and instead the coupling sections 56 and 57 coupled to the insulation displacement conductive section 4 is subjected to squeezing to reinforce the insulation displacement conductive section 4. Hence, in the case where the insulation displacement conductive section 4 is not reinforced, or in the case where it is difficult to reinforce the insulation displacement conductive section 4, the insulation displacement blades 11 can be positively prevented from being opened outwardly opened.

As was described the above, the insulation displacement conductive section 4 has the front insulation displacement portion 10A and the rear insulation displacement portion 10B respectively at the front and rear ends, and the right insulation displacement blades 11 are coupled through the coupling wall 62 to each other, and similarly the left insulation displacement blades 11 are coupled through the coupling wall 62 to each other; in other words, the right insulation displacement blades 11 of the front and rear insulation displacement portions 10A and 10B are integral with each other, and the left insulation displacement blades 11 of the front and rear insulation displacement portions 10A and 10B are also integral with each other. Hence, the side walls 54 equally prevent the insulation displacement blades 11 of the two insulation displacement portions 10A and 10B from being opened outwardly. Furthermore, the side walls 54 of the insulation displacement conductive section 4 have the rectangular openings 61, respectively, and the protrusions extended from the front and rear edges of the rectangular openings 61 are bent inwardly to form the insulation displacement blades 11. Hence, the insulation displacement blades 11, which is high in mechanical resistance, whose upper edges are coupled through the coupling walls 62 to each other, can be obtained easily.

Second Embodiment

Next, an insulation displacement terminal of a second embodiment of the invention, will now be described with reference to FIG. 3.

Figure 3:
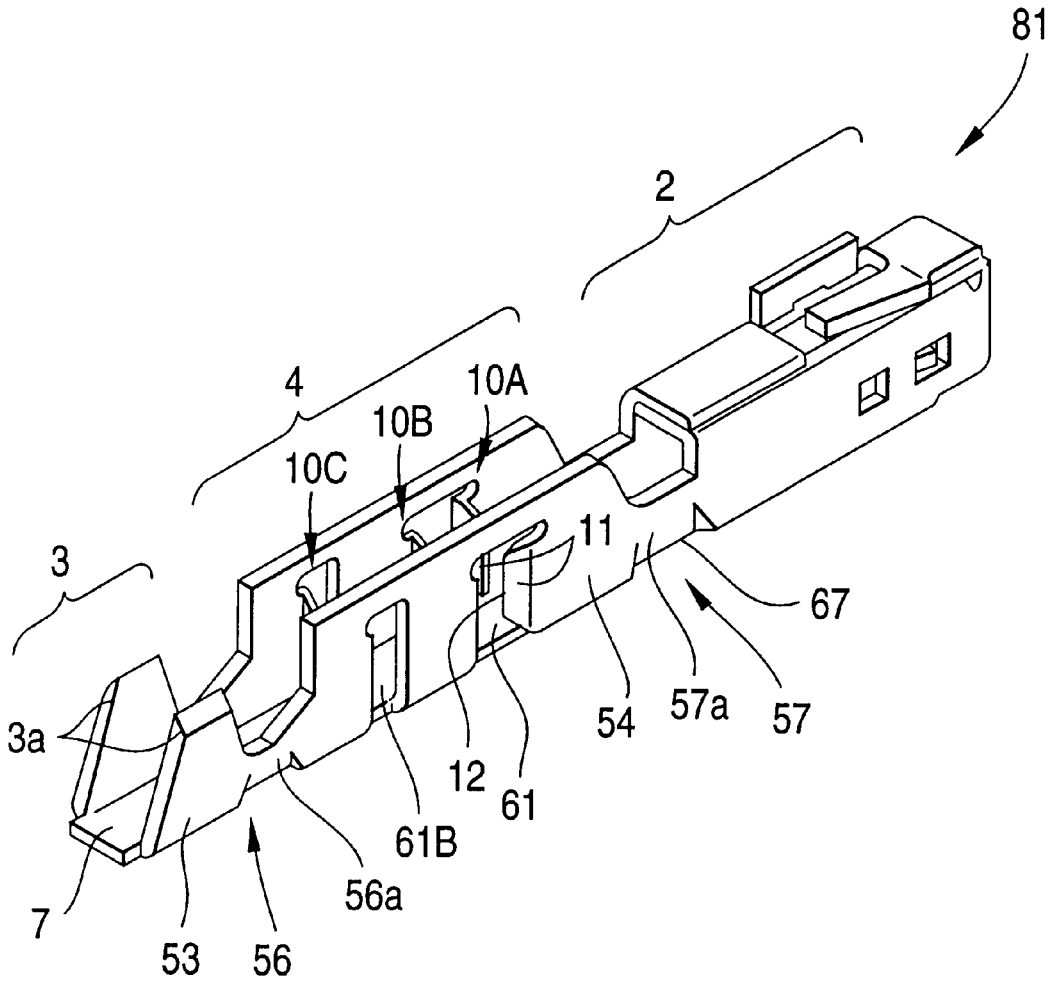
FIG. 3 is a perspective view of another example of the insulation displacement terminal of a second embodiment of the invention.
Figure 4A:
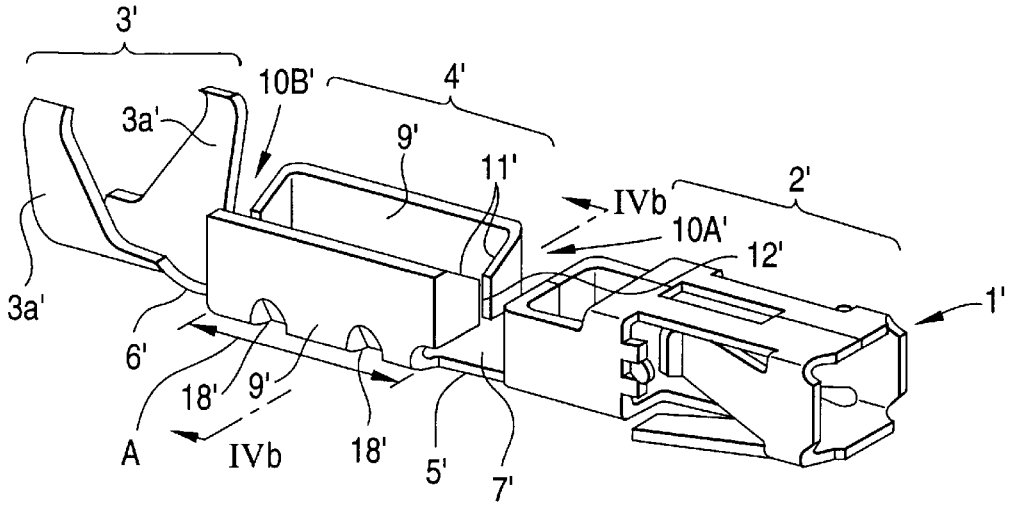
FIG. 4a PRIOR ART
FIGS. 4*a* to 4*c* show a conventional insulation displacement terminal.
Figure 4B:
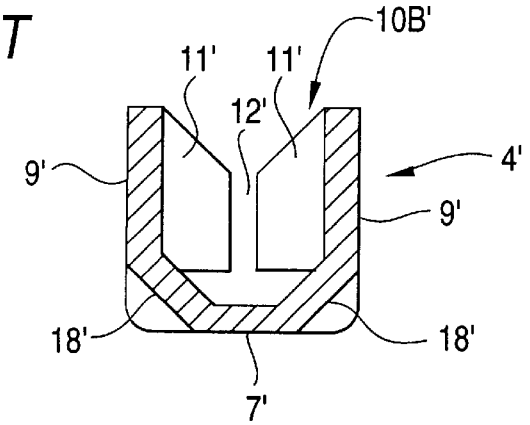
FIG. 4b PRIOR ART
Figure 4C:
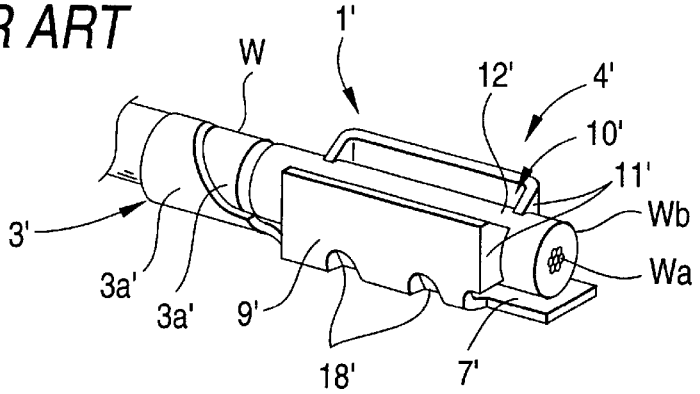
FIG. 4c PRIOR ART

In FIG. 3, reference numeral 81 designates the insulation displacement terminal of the second embodiment of the invention. The insulation displacement terminal 81 is substantially similar in structure to the insulation displacement terminal 51 of the first embodiment. That is, the insulation displacement terminal 81 is different from the crimping terminal 51 in the following points: The insulation displacement conductive section 4 has two insulation displacement portions 10A and 10B (hereinafter referred to as "first and second insulation displacement portions 10A and 10B"), and also has a third insulation displacement portion 10C at the rear end portion. The right and left side walls 54 of the insulation displacement conductive section 4 have the openings 61 (hereinafter referred to as "first openings 61"), and second openings 61B behind the first openings. Protrusions extended from the rear edges of the second openings 61B are bent inwardly, to form the insulation displacement blades 11 and the insulation displacement slot 12 of the third insulation displacement portion 10C. The other arrangements are similar to those of the above-described first embodiment. In FIG. 3, parts corresponding functionally to those already described in the first embodiment are therefore designated by the same reference numerals or characters.

In the second embodiment, since the first and second openings 61 and 61B provide the first, second and third insulation displacement portions 10A, 10B and 10C, the wire is more positively held with the insulation displacement terminal, and the electrical connection is improved in reliability.

The second opening 61B may be located in front of the first openings 61. In the second embodiment, the third insulation displacement portion 10C is formed by using the rear edges of the second openings 61B; however, it may be formed by using the front edges thereof as a fourth insulation displacement portion. Furthermore, the third and fourth insulation displacement portions may be formed by using both of the front and rear edges of the second openings 61B. The number of insulation displacement portions should be at least one, and the number of openings should be determined according to the number of insulation displacement portions.

As was described above, in the insulation displacement terminal, the coupling section coupled to the insulation displacement conductive section has the squeezed portion. Therefore, the step which attributes to the change in sectional configuration of the squeezed portion, the coupling section is increased in mechanical strength, and accordingly the side walls of the insulation displacement conductive section is reinforced. Hence, the right and left side walls of the insulation displacement conductive section are substantially prevented from falling aside; that is, when the wire is pushed in the insulation displacement slots of the insulation displacement conductive section, the right and left insulation displacement blades are prevented from being opened outwardly. Accordingly, in the case where the width of the insulation displacement blades are decreased to miniaturize the insulation displacement terminal, the resultant insulation displacement terminal is free from difficulty that, when the wire is pushed in the insulation displacement slots, the insulating cover of the wire is unsatisfactory cut, and furthermore the contact load (or holding load) on the conductor Wa of the wire W can be high enough; that is, the electrical connection is improved in reliability. In this case, as was described before, the insulation displacement conductive section is not directly subjected to squeezing, and instead the coupling section adjacent thereto is subjected to squeezing to reinforce the insulation displacement conductive section. Hence, in the case where the insulation displacement conductive section is not reinforced, or it is difficult to reinforce the insulation displacement conductive section, the insulation displacement blades are prevented from being opened outwardly.

Further, the insulation displacement terminal has the following effects in addition to the above. The insulation displacement conductive section is continuously coupled to the wire clamping section through the coupling section, and therefore the side walls of the insulation displacement conductive section are restricted by the wire clamping section. Accordingly, when the wire is pushed in the insulation displacement slots of the insulation displacement conductive section, the right and left insulation displacement blades are scarcely opened outwardly because the side walls having the insulation displacement blades are restricted in movement. The clamping of the wire and the pushing of the wire in the insulation displacement slots are carried out at the same time, the side walls of the wire clamping section are bent inwardly when the wire is clamped. Therefore, even if the insulation displacement blades of the insulation displacement conductive section tend to open outwardly as the wire is pushed in the insulation displacement slots, the insulation displacement blade is prevented from being opened because an inward force acting on the side walls of the wire clamping section, and the outward force acting on the side walls of the insulation displacement conductive section through the insulation displacement blades are canceled out by each other.

Further, the insulation displacement terminal has the following effects in addition to the above. The sectional configuration of the bottom wall is changed from flat to arcuate from both front and rear towards the center thereof, which reinforces the coupling sections and the side walls of the insulation displacement conductive section.

Further, the insulation displacement terminal has the following effects in addition to the above. The first openings are formed in the side walls of the insulation displacement conductive section, and the protrusion extended from the front and area edges of each of the first openings are bent inwardly to form the insulation displacement blades. Therefore, the peripheral portion of each of the side walls remain in the form of a frame; that is, the insulation displacement blades which are high in resistance against the opening of themselves can be obtained with the mechanical strength of the side wall being maintained substantially unchanged. Especially, since the front and rear ends of the side walls have no insulation displacement blades, the front end rear ends of the side walls my be continuously coupled to the side walls of the electrical contact section and those of the wire clamping section as they are. This feature increases the mechanical strength of the side walls of insulation displacement conductive section with ease.

Further, the insulation displacement terminal has the following effects in addition to the above. Because of the formation of the first and second openings in the side walls, at least three insulation displacement portions can be arranged in the front-to-rear direction. This feature prevents the insulation displacement blades of the insulation displacement portions from being opened outwardly.

What is claimed is:

1. An insulation displacement terminal, comprising:

an electrically conductive plate including:

an electrical contact section engageable with another terminal;

a wire clamping section for clamping a wire thereto;

an insulation displacement conductive section located between the electrical contact section and the wire clamping section, the insulation displacement conductive section having a bottom wall, a first side wall and a second side wall, the first and second side walls which have first and second insulation displacement blades extending inwardly to confront each other so as to define an insulation displacement slot therebetween; and at least one coupling section, which is substantially U-shaped in cross-section, having a bottom wall, a first side wall and a second side wall, the coupling section being formed in at least one of a portion between the insulation displacement conductive section and the wire clamping section and a portion between the insulation displacement conductive section and the electrical contact section, and the coupling section including a squeezed portion having a reduced cross-section as compared to the adjacent cross-sections of said insulation displacement conductive section, electrical contact section, or wire clamping section.

2. The insulation displacement terminal of claim 1, wherein the wire clamping section has a bottom wall, a first side wall and a second side wall, a portion of the first side wall and a portion of the second side wall are respectively bent inwardly to clamp the wire through an insulting cover thereof.

3. The insulation displacement terminal of claim 2, wherein the coupling section is provided between the insulation displacement conductive section and the wire clamping section so that the side walls of the insulation displacement conductive section are coupled to the side walls of the wire clamping section through the side walls of the coupling section, respectively, and the bottom wall of the insulation displacement conductive section is coupled to the bottom wall of the wire clamping section through the bottom wall of the coupling section.

4. The insulation displacement terminal of claim 1, wherein the squeezed portion is formed so as to gradually change a sectional configuration of the bottom wall of the coupling section from flat to arcuate in section along both sides toward the bottom center.

5. The insulation displacement terminal of claim 1, wherein the first and second side walls of the insulation displacement conductive section have first openings, respectively, and protrusions, extended from front and rear edges of each of the first openings, and bent inwardly to form said insulation displacement blades.

6. The insulation displacement terminal of claim 5, wherein the first and second side walls further have second openings in such a manner that the second openings are in alignment with the first openings, and protrusions, extended from at least one of the front edge and a rear edge of the second opening, are bent inwardly to form said insulation displacement blades.

7. The insulation displacement terminal of claim 1, wherein the squeezed portion is formed so as to change the cross-section of the coupling section from a rectangular U-shape to a curved U-shape.

* * * * *